US009211632B2

(12) United States Patent
Chen

(10) Patent No.: US 9,211,632 B2
(45) Date of Patent: Dec. 15, 2015

(54) WATERPROOF SANDER

(71) Applicant: X'POLE PRECISION TOOLS INC., Zhongli, Taoyuan County (TW)

(72) Inventor: Bach Pangho Chen, Claremont, CA (US)

(73) Assignee: X'POLE PRECISION TOOLS INC., Zhongli, Taoyuan County (TW)

( * ) Notice: Subject to any disclaimer, the term of this patent is extended or adjusted under 35 U.S.C. 154(b) by 241 days.

(21) Appl. No.: 13/970,913

(22) Filed: Aug. 20, 2013

(65) Prior Publication Data

US 2015/0056896 A1 Feb. 26, 2015

(51) Int. Cl.

| | |
|---|---|
| ***B24B 23/04*** | (2006.01) |
| ***B24B 55/05*** | (2006.01) |
| ***B24B 23/03*** | (2006.01) |

(52) U.S. Cl.

CPC ..... *B24B 55/05* (2013.01); *B24B 23/03* (2013.01); *B24B 23/04* (2013.01)

(58) Field of Classification Search

CPC ..... B24B 23/03; B24B 23/04; B24B 55/05

USPC ..... 451/356, 357, 451

See application file for complete search history.

(56) References Cited

U.S. PATENT DOCUMENTS

| | | | | |
|---|---|---|---|---|
| 5,022,190 | A * | 6/1991 | Hutchins | 451/357 |
| 5,419,737 | A * | 5/1995 | Brazell et al. | 451/453 |
| 5,580,302 | A * | 12/1996 | Howard et al. | 451/357 |
| 2002/0111127 | A1 * | 8/2002 | Tseng | B24B 5/102 451/358 |
| 2004/0082286 | A1 * | 4/2004 | Liu | 451/451 |
| 2005/0079808 | A1 * | 4/2005 | Tiede et al. | 451/357 |
| 2008/0028568 | A1 * | 2/2008 | Tiede et al. | 15/329 |

FOREIGN PATENT DOCUMENTS

| | | |
|---|---|---|
| TW | 517618 | 1/2003 |

* cited by examiner

*Primary Examiner* — Monica Carter
*Assistant Examiner* — Marcel Dion
(74) *Attorney, Agent, or Firm* — Muncy, Geissler, Olds & Lowe, P.C.

(57) ABSTRACT

A waterproof sander comprises a body and a waterproof cover. The body has a housing to hold a drive motor, a drive board driven by the drive motor to proceed a rotational displacement and a sanding disk movable by the drive board and separated from the housing to form a gap between them. The waterproof cover includes a first sealing portion, a mask portion extended from the first sealing portion, and a second sealing portion integrally extended from the mask portion. The first sealing portion is attached to the housing. The mask portion covers the gap. The second sealing portion is located between the drive board and sanding disk to prevent liquid from flowing into the body to provide waterproof effect.

8 Claims, 7 Drawing Sheets

WATERPROOF SANDER

FIELD OF THE INVENTION

The present invention relates to a sander and particularly to a waterproof sander.

BACKGROUND OF THE INVENTION

A conventional machine tool usually is made in a small size and can be coupled with different application tools to provide various types such as a grinder, sander, drilling machine, electric wrench and the like. Such a machine tool can aid users to quickly polish articles such as woods and paint of vehicles. The machine tool can be an electric machine tool driven by electric power or a pneumatic machine tool driven by pressurized air. The conventional pneumatic sander generally includes a transmission mechanism, a driven mechanism located on the transmission mechanism and a sanding mechanism fastened to the driven mechanism. When the pneumatic sander is in operation, the transmission mechanism drives a sanding disk of the sanding mechanism to perform a reciprocal movement for sanding objects.

During operation of the pneumatic sander dust and debris are easily generated to impact environmental neatness or cause jamming of the machine tool. Hence the pneumatic sander generally is equipped with a dustproof cover to remove the dust and debris generated during operation. For instance, Taiwan patent No. 517618 discloses an air discharge structure for pneumatic sanders. The air discharge structure includes a sanding wheel with dust suction vents formed thereon. The sanding wheel has a dustproof cover fastened to a motor housing. The motor housing holds a pneumatic motor with a movable vane. It also has an air intake duct and an air exit duct that are adjacent to each other and extended from one side of the motor housing. The air intake duct and air exit duct have respectively an air intake valve set and a discharge noise muffler, and a chamber located thereabove to hold a throttle valve and an adjustment knob. The motor housing also is extended from the top surface to form a pair of wings opposing each other to fasten a movable air intake trigger. The duct cover has a housing trough extended inside to pivotally couple with the air exit duct. The housing trough is extended to a duct junction of the dustproof cover. The air exit duct has a substantially L-shaped tube inside with a flow guide plate at a lower end to direct the air generated by the movable vane upwards to be discharged through an air outlet. The lower end of the tube is extended close to the front end of the duct junction so that exit air of the motor is converged at the outlet of the duct junction, thereby dust and debris generated after sanding operation can be quickly sucked by the powerful exit airflow.

Although the aforesaid conventional pneumatic sander can be coupled with an additional dust collection duct and dustproof cover to suck dust during operation of the sander, the sander not merely performs sanding operation on sanding articles that generate dust and debris, also could be used in operation with liquid involved (such as ultrafine fly ash grinder). In such operation the sander is not merely positioned upright, also can be positioned upside down or sideward. As a result, the liquid easily seeps into the pneumatic sander through gaps formed between the dustproof cover and base, or crevices of the installation port, or even seeps into the high speed spinning cylinder or bearings, to cause damage of the elements of the pneumatic sander.

SUMMARY OF THE INVENTION

The primary object of the present invention is to provide a waterproof cover on a machine tool to achieve waterproof effect.

To achieve the foregoing object, the present invention provides a waterproof sander that includes a body and a waterproof cover. The body has a housing to hold a drive motor, a drive board driven by the drive motor to proceed a rotational displacement and a sanding disk movable by the drive board and separated from the housing to form a gap between them. The waterproof cover is coupled on the body and includes a mask portion to cover the gap, a first sealing portion attached to the housing and a second sealing portion integrally extended from the mask portion and located between the drive board and sanding disk. The mask portion and housing form a housing space to allow air to circulate for driving the drive motor.

In one embodiment the second sealing portion includes at least a first jutting ring protrusive towards the drive board.

In another embodiment the second sealing portion includes at least a second jutting ring protrusive towards the sanding disk.

In yet another embodiment the drive board includes at least one first positioning hole, and the second sealing portion includes at least one fastening hole corresponding to the first positioning hole that are fastened together via a fastening element to fixedly couple the drive board and second sealing portion.

In yet another embodiment the sanding disk includes at least one second positioning hole corresponding to the fastening hole that are fastened via the fastening element to fixedly couple the sanding disk and second sealing portion together.

In yet another embodiment the invention further includes a latch ring latchable on the first sealing portion to fasten the first sealing portion to the housing.

In yet another embodiment the mask portion includes an air outlet running through thereof.

In yet another embodiment the invention further includes a stop plate to cover the air outlet. The stop plate has a stop portion formed at a diameter greater than the air outlet to surround and mask the air outlet.

In yet another embodiment the mask portion includes at least one positioning opening corresponding to the fastening hole.

In yet another embodiment the invention further includes a stop plate to cover the positioning opening. The stop plate has at least one sealing element corresponding to the positioning opening.

The invention, by means of the technique set forth above, compared with the conventional techniques, provides many advantages, notably:

1. Prevent liquid from flowing via the gap between the drive board and sanding disk or crevices in the installation port to the body, thus can achieve waterproof effect.

2. Provide enhanced fastening and tight coupling.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
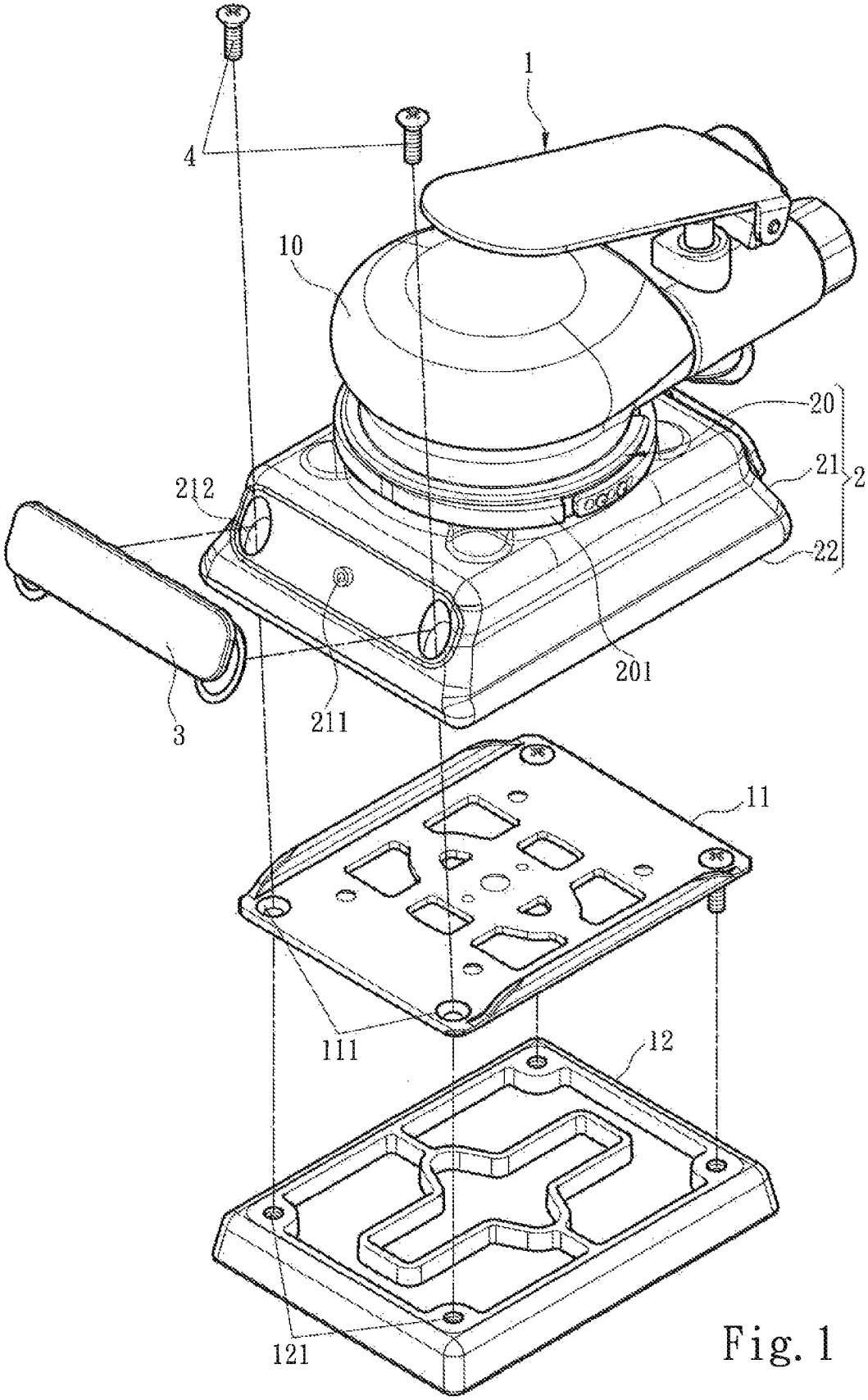
FIG. 1 is an exploded view of a first embodiment of the waterproof sander of the invention.
Figure 2:
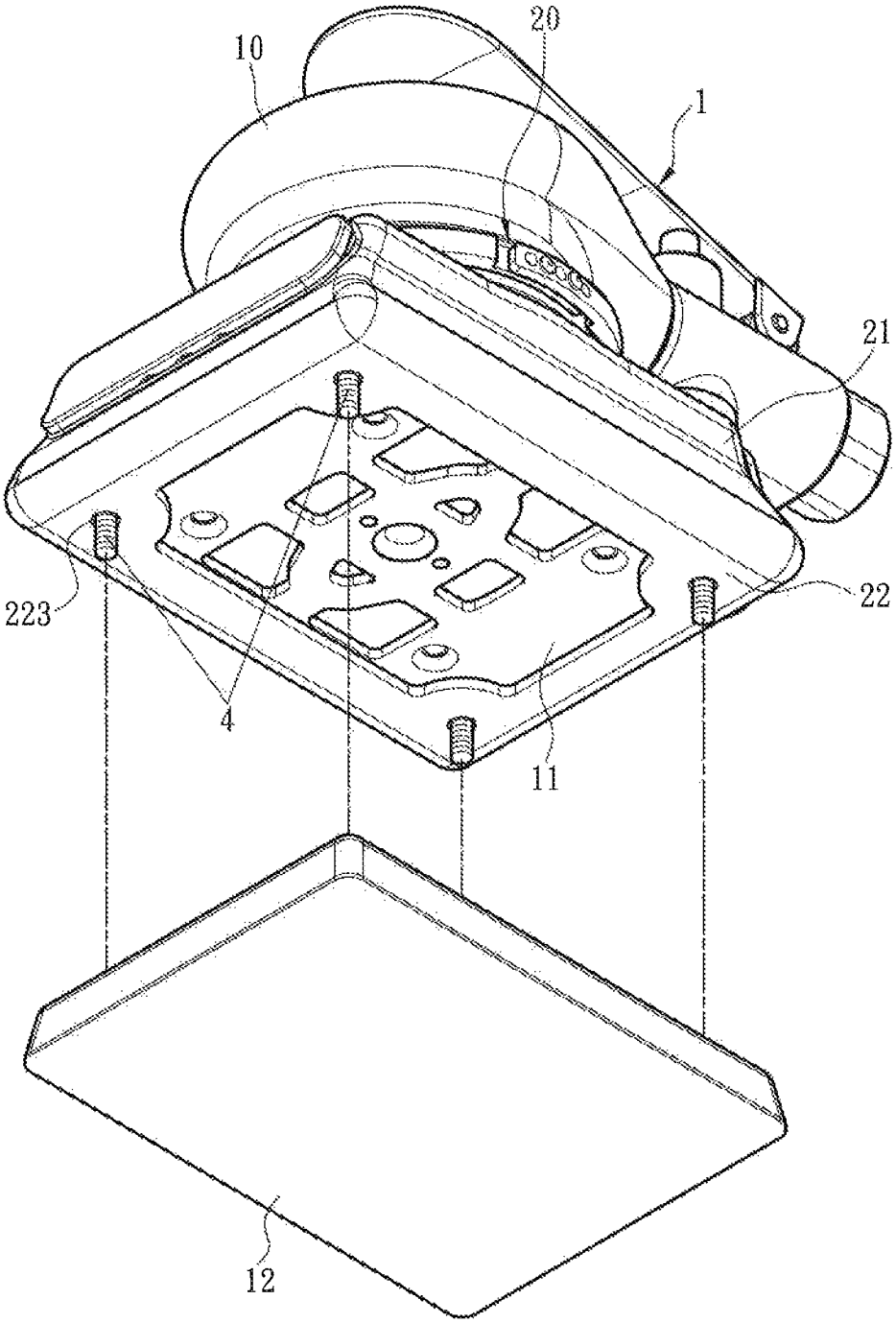
FIG. 2 is another exploded view of the first embodiment of the waterproof sander of the invention.
Figure 3:
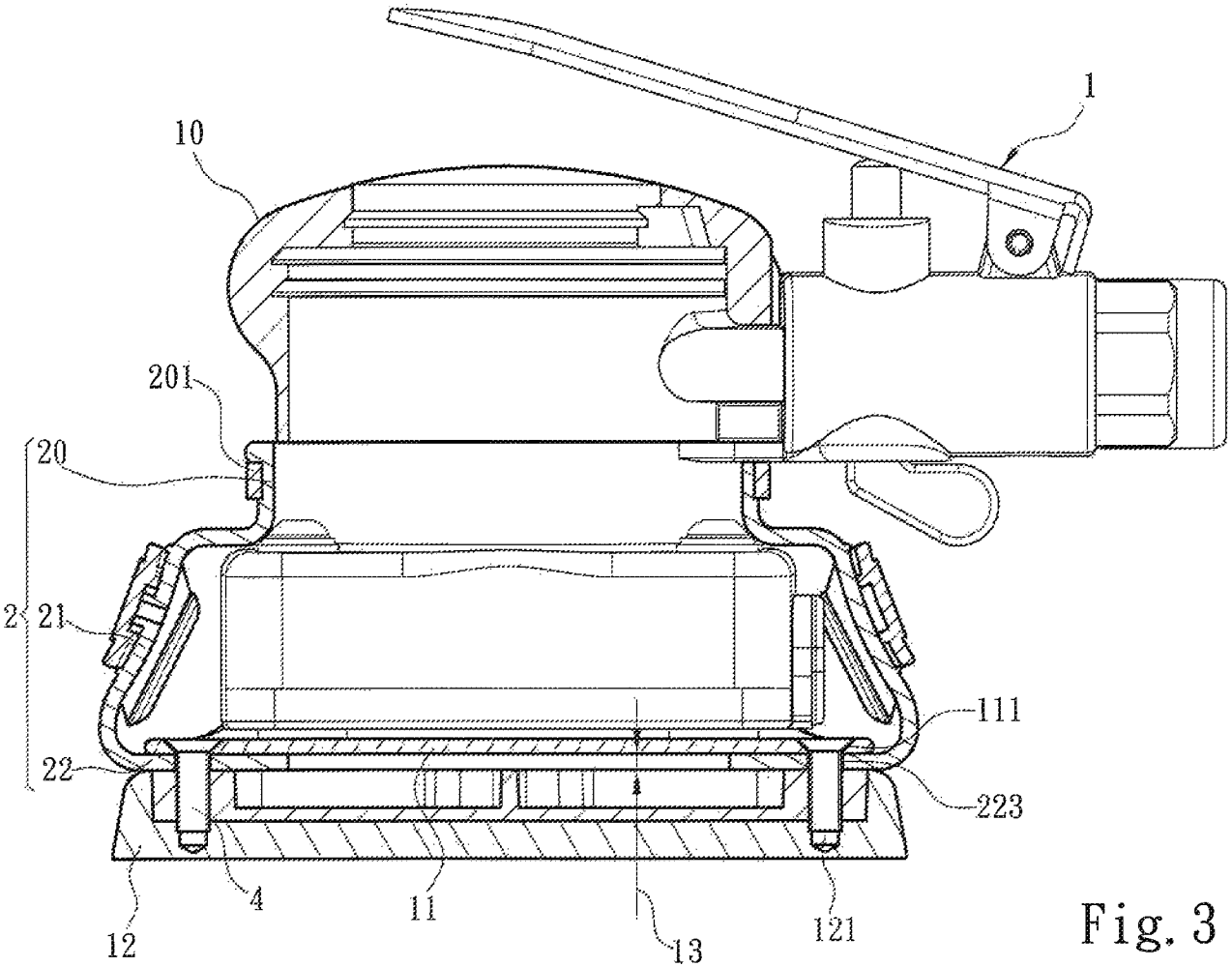
FIG. 3 is a sectional view of the first embodiment of the waterproof sander of the invention.

Please refer to FIGS. 1, 2 and 3, the present invention aims to provide a waterproof sander which comprises a body 1 and a waterproof cover 2. The body 1 includes a housing 10, a drive board 11 and a sanding disk 12. The housing 10 holds a drive motor (the drive motor is technique known in the art, thus details are omitted herein). The drive board 11 is driven by the drive motor to proceed a rotational displacement. The drive board 11 has at least one first positioning hole 111. The sanding disk 12 is movable by the drive board 11 and separated from the housing 10 to form a gap 13 between them. The waterproof cover 2 includes a first sealing portion 20, a mask portion 21 and a second sealing portion 22. The waterproof cover 2 can be coupled on the body 1 with the first sealing portion 20 attached to the housing 10. The mask portion 21 is extended from the first sealing portion 20 to cover the gap 13. The second sealing portion 22 is integrally extended from the mask portion 21 and located between the drive board 11 and sanding disk 12. The second sealing portion 22 has at least one fastening hole 223 corresponding to the first positioning hole 111. The sanding disk 12 has a second positioning hole 121 corresponding to the fastening hole 223. The first positioning hole 111, fastening hole 223 and second positioning hole 121 are fastened by a fastening element 4 to clamp the second sealing portion 22 between the drive board 11 and sanding disk 12. And the second sealing portion 22, drive board 11 and sanding disk 12 also are fastened together, thereby the waterproof cover 2 is securely coupled on the body 1 with the mask portion 21 covering the gap 13 and a portion of the housing 10, thereby can prevent liquid from flowing through the gap between the drive board 11 and sanding disk 12 or crevices of the installation port into the body 1 to achieve water proof effect.

In this embodiment, the first sealing portion 20 can be latched via, a latch ring 201, namely, when the waterproof cover 2 is coupled on the housing 10, the first sealing portion 20 is latched via the latch ring 201 so that the first sealing portion 20 can be fixedly attached to the housing 10, and the second sealing portion 22 is clamped between the drive board 11 and sanding disk 12. Finally, the first positioning hole 111, second positioning hole 121 and fastening hole 223 are fastened together via the fastening element 4 to anchor the waterproof cover 2 on the body 1, thereby prevent liquid from flowing via the gap between the drive board 11 and sanding disk 12, or crevices in the installation port into the body 1 to enhance waterproof effect.

Figure 5:
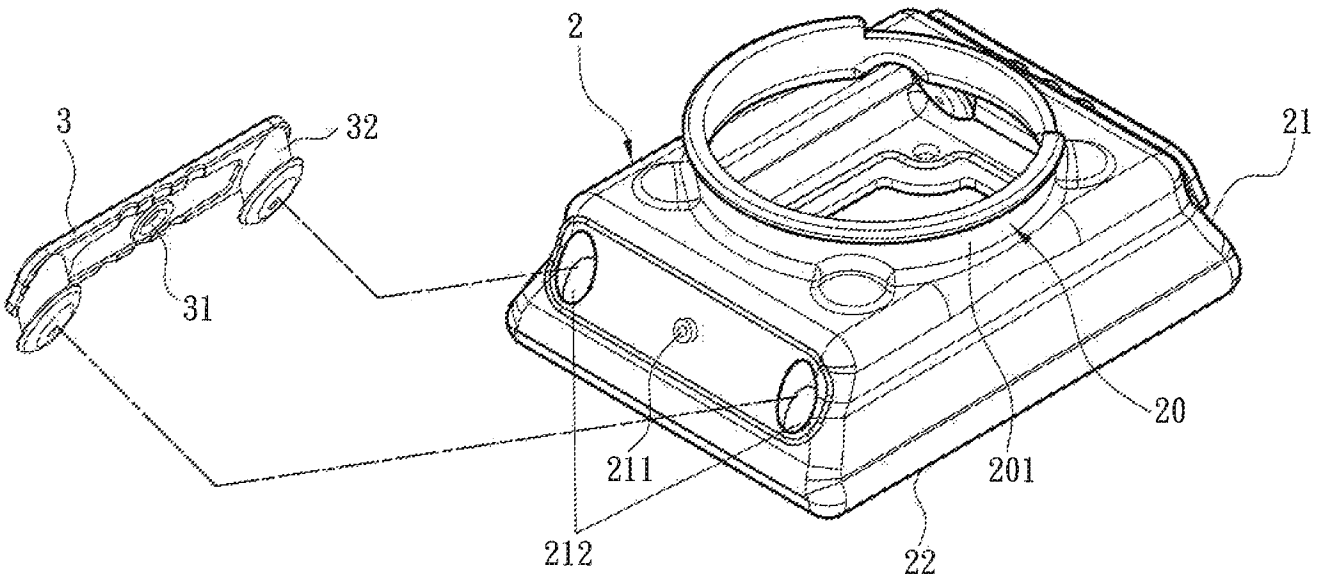
FIG. 5 is a fragmentary exploded view of the first embodiment of the waterproof sander of the invention.
Figure 6:
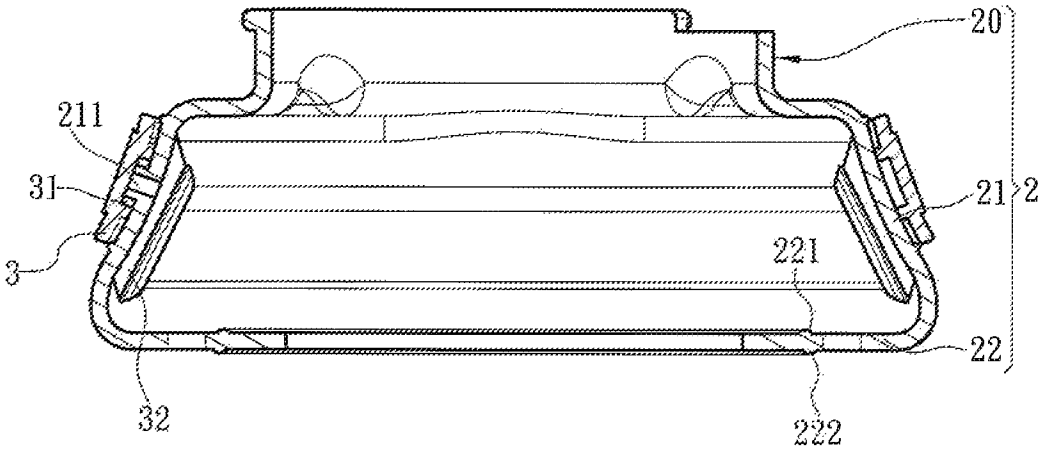
FIG. 6 is a fragmentary sectional vi of the first embodiment of the waterproof sander of the invention.

Please also refer to FIGS. 5 and 6, in the first embodiment, the waterproof cover 2 further can include an air outlet 211 running through the mask portion 21 and at least one positioning opening 212 corresponding to the fastening hole 223. Through the air outlet 211, air circulating between the mask portion 21 and housing 10 to drive the drive motor can is be discharged. A stop plate 3 also is provided which has a stop portion 31 formed at a diameter greater than the air outlet 211 and at least one sealing element 32 corresponding to the positioning opening 212. In this embodiment, the positioning opening 212 is an opening with an inclined surface at one side. During fastening of the fastening element 4, the inclined surface provides alignment with the first positioning hole 111, second positioning hole 121 and fastening hole 223 to facilitate fastening. The stop portion 31 is an annular boss. When the stop plate 3 covers the positioning opening 212, the sealing element 32 plugs in the positioning opening 212 for anchoring so that the stop plate 3 can be securely mounted onto the mask portion 21. Since the stop portion 31 is formed at a diameter greater than that of the air outlet 211, when the stop plate 3 covers the positioning opening 212, the stop portion 31 surrounds and masks the air outlet 211, thereby the stop portion 31 also can prevent the liquid from flowing through the waterproof cover 2 into the body 1. In addition, the air pressure between the waterproof cover 2 and housing 10 (i.e., between the mask portion 21 and housing 10) is greater than the external air pressure outside the body 1. When the liquid flows to the stop portion 31, the air between the mask portion 21 and housing 10 is discharged as the internal air pressure is greater than the external air pressure and the liquid also is discharged from the stop portion 31, thus can is prevent the liquid from entering the waterproof cover 2.

Figure 4A:
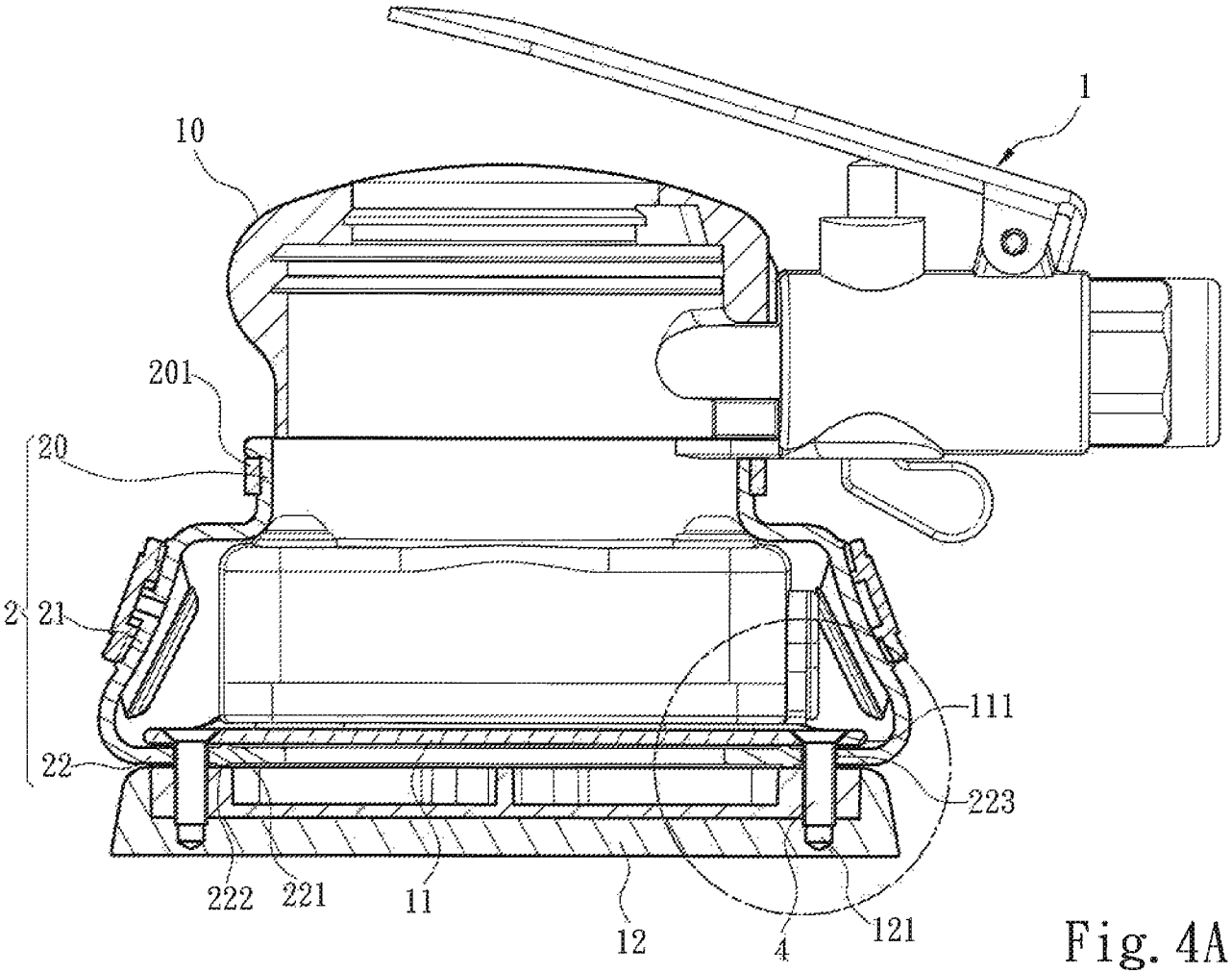
FIG. 4A is a sectional view of a second embodiment of the waterproof sander of the invention.
Figure 4B:
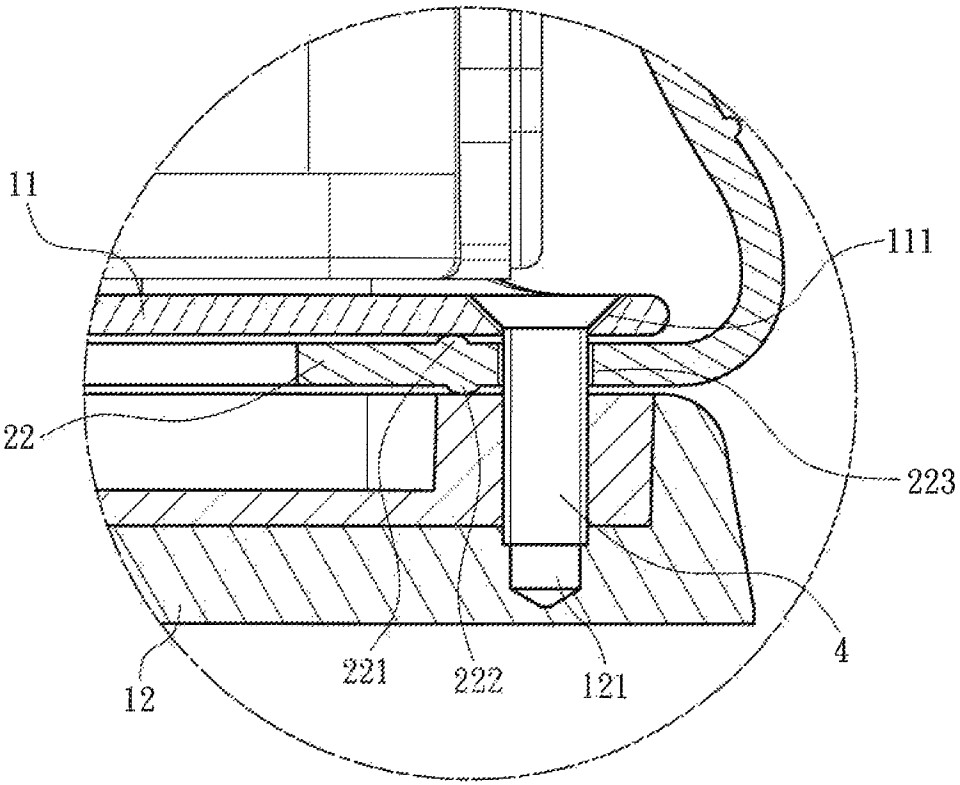
FIG. 4B is a fragmentary enlarged sectional view of the second embodiment of the waterproof sander of the invention.

Please refer to FIGS. 4A and 4B for a second embodiment of the invention. It is substantially constructed same as the first embodiment, The main difference is that the second sealing portion 22 has at least one first jutting ring 221 protrusive towards the drive board 11 and/or a second jutting ring 222 protrusive towards the sanding disk 12. When the second sealing portion 22 is clamped between the drive board 11 and sanding disk 12, the first jutting ring 221 and/or second jutting ring 222 tightly press the drive board 11 and/or sanding disk 12. In this embodiment the first jutting ring 221 is formed on upper surface of the second sealing portion 22 (abutting the drive board 11) and the second jutting ring 222 is formed on the lower surface of the second sealing portion 22 (abutting the sanding disk 23). When the second sealing portion 22 is clamped between the drive board 11 and sanding disk 12, the first and second jutting rings 221 and 222 press tightly the drive board 11 and sanding disk 12, namely, by providing a jutting ring on one surface or two surfaces of the second sealing portion 22, fastening sturdiness and coupling tightness can be enhanced.

As a conclusion, the waterproof sander of the invention mainly includes a body and a waterproof cover. The body has a housing, a drive board and a sanding disk. The housing holds a drive motor. The drive board is driven by the drive motor to proceed a rotational displacement. The sanding disk is movable by the drive board and separated from the housing to form a gap between them. The waterproof cover includes a mask portion, a first sealing portion and a second sealing portion integrally extended from the mask portion. The mask portion and housing form a housing space to allow air to circulate for driving the drive motor. The waterproof cover can be coupled on the body. The mask portion covers the gap. The first sealing portion is attached to the housing. The second sealing portion is clamped between the drive board and sanding disk. Thus liquid can be prevented from flowing into the body through the gap between the drive board and sanding disk or crevices in the installation port, thereby provide waterproof effect.

What is claimed is:

1. A waterproof sander, comprising:

a body including a housing to hold a drive motor, a drive board driven by the drive motor to proceed a rotational displacement and a sanding disk movable by the drive board and separated from the housing to form a gap between them;

a waterproof cover which is coupled on the body and includes a first sealing portion attached to the housing, a mask portion extended from the first sealing portion to cover the gap and a second sealing portion extended from the mask portion and located between the drive board and the sanding disk, wherein the mask portion includes an air outlet running through thereof; and a stop plate to cover the air outlet, the stop plate including a stop portion formed at a diameter greater than the air outlet to surround and mask the air outlet.

2. The waterproof sander of claim 1, wherein the second sealing portion includes at least one first jutting ring protrusive towards the drive board.

3. The waterproof sander of claim 1, wherein the second sealing portion includes at least one second jutting ring protrusive towards the sanding disk.

4. The waterproof sander of claim 1, wherein the drive board includes at least one first positioning hole, the second sealing portion including at least one fastening hole corresponding to the first positioning hole, the first positioning hole and the fastening hole being fastened together through a fastening element to fixedly couple the drive board and the second sealing portion.

5. The waterproof sander of claim 4, wherein the sanding disk includes at least one second positioning hole corresponding to the fastening hole, the second positioning hole and the fastening hole being fastened together through the fastening element to fixedly couple the sanding disk and the second sealing portion.

6. The waterproof sander of claim 4, wherein the mask portion includes at least one positioning opening corresponding to the fastening hole.

7. The waterproof sander of claim 6 further including a stop plate to cover the positioning opening, the stop plate including at least one sealing element corresponding to the positioning opening.

8. The waterproof sander of claim 1 further including a latch ring latchable on the first sealing portion to anchor the first sealing portion on the housing.

* * * * *